US009352568B2

(12) United States Patent
Rivas et al.

(10) Patent No.: US 9,352,568 B2
(45) Date of Patent: May 31, 2016

(54) FLUID EJECTION DEVICE WITH PARTICLE TOLERANT THIN-FILM EXTENSION

(75) Inventors: Rio Rivas, Corvallis, OR (US); Ed Friesen, Corvallis, OR (US); Kellie Susanne Jensen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/397,151

(22) PCT Filed: Jul. 24, 2012

(86) PCT No.: PCT/US2012/047932

§ 371 (c)(1),
(2), (4) Date: Oct. 24, 2014

(87) PCT Pub. No.: WO2014/018008

PCT Pub. Date: Jan. 30, 2014

(65) Prior Publication Data

US 2015/0124024 A1 May 7, 2015

(51) Int. Cl.

| | |
|---|---|
| ***B41J 2/175*** | (2006.01) |
| ***B41J 2/05*** | (2006.01) |
| ***B41J 2/14*** | (2006.01) |

(52) U.S. Cl.

CPC ..... *B41J 2/14427* (2013.01); *B41J 2/1404* (2013.01); *B41J 2/14201* (2013.01); *B41J 2002/14403* (2013.01); *B41J 2002/14467* (2013.01)

(58) Field of Classification Search

None

See application file for complete search history.

(56) References Cited

U.S. PATENT DOCUMENTS

| | | | | |
|---|---|---|---|---|
| 5,463,413 | A * | 10/1995 | Ho | B41J 2/1404 347/65 |
| 5,575,560 | A | 11/1996 | Kaneski et al. | |
| 6,554,403 | B1 * | 4/2003 | Chen et al. | 347/63 |
| 2003/0137562 | A1 | 7/2003 | Kawamura et al. | |
| 2003/0141277 | A1 * | 7/2003 | Beatty et al. | 216/27 |
| 2006/0232636 | A1 | 10/2006 | Bengali | |

FOREIGN PATENT DOCUMENTS

| | | |
|---|---|---|
| CN | 101077652 | 12/2010 |
| KR | 1020040019461 | 3/2004 |
| KR | 1020080086761 | 9/2008 |
| WO | 2008069798 | 6/2008 |

OTHER PUBLICATIONS

International Searching Authority, "International Search Report," issued in connection with PCT Application Serial No. PCT/US2012/047932, mailed Mar. 15, 2013, 7 pages.

International Searching Authority, "Written Opinion," issued in connection with PCT Application Serial No. PCT/US2012/047932, mailed Mar. 15, 2013, 5 pages.

* cited by examiner

*Primary Examiner* — Erica Lin

(74) *Attorney, Agent, or Firm* — HP Inc. Patent Department

(57) ABSTRACT

In an embodiment, a fluid ejection device includes a thin-film layer formed over a substrate, a chamber layer formed over the thin-film layer, the chamber layer defining a fluidic channel that leads to a firing chamber, a slot extending through the substrate and into the chamber layer through an ink feed hole in the thin-film layer, and a particle tolerant thin-film extension of the thin-film layer that protrudes into the slot from between the substrate and the chamber layer.

16 Claims, 7 Drawing Sheets

View A-A
from FIG. 2

FLUID EJECTION DEVICE WITH PARTICLE TOLERANT THIN-FILM EXTENSION

BACKGROUND

Fluid ejection devices in inkjet printers provide drop-on-demand ejection of fluid drops. Inkjet printers produce images by ejecting ink drops from ink-filled chambers through nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within the ink-filled chamber. In another example, a piezoelectric inkjet printhead uses a piezoelectric material actuator to generate pressure pulses that force ink drops out of a nozzle.

Rapidly refilling the chambers with ink enables increased printing speeds. However, as ink flows into the chambers from a reservoir, small particles in the ink can get lodged in and around the channel inlets that lead to the chambers. These small particles can diminish and/or completely block the flow of ink to the chambers, which can result in the premature failure of heating elements, reduced ink drop size, misdirected ink drops, and so on. As small particles inhibit ink flow to more and more chambers, the resultant failures in corresponding nozzles can noticeably reduce the print quality of a printer.

BRIEF DESCRIPTION OF THE DRAWINGS

The present embodiments will now be described, by way of example, with reference to the accompanying drawings, in which.

DETAILED DESCRIPTION

Overview

Figure 1:
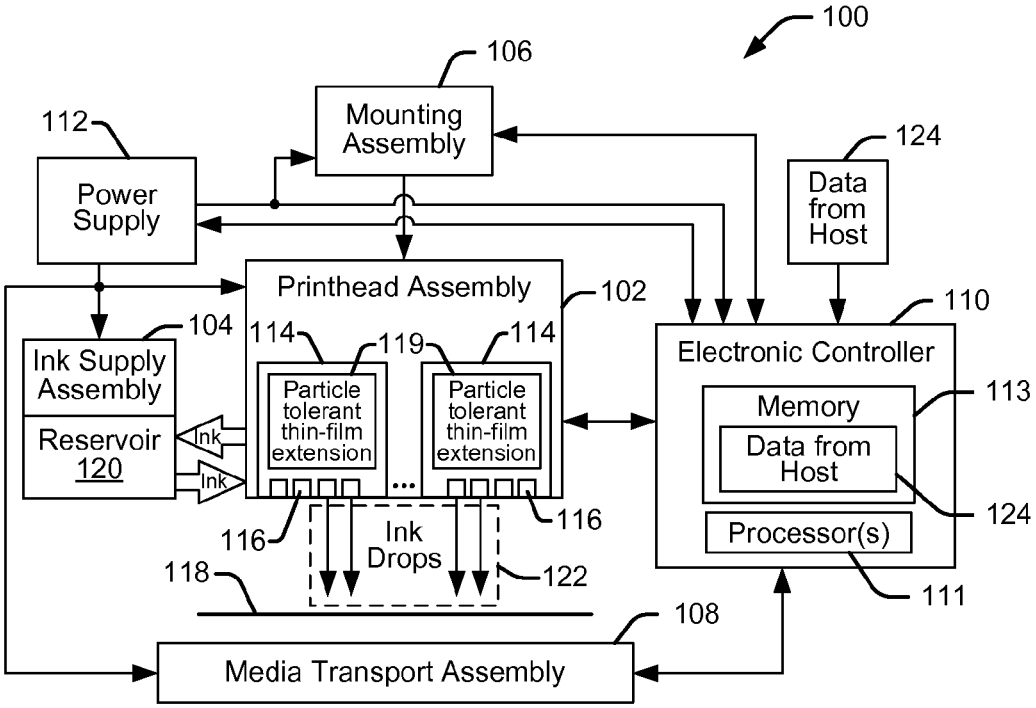
FIG. 1 illustrates a fluid ejection system implemented as an inkjet printing system, according to an embodiment.

As noted above, small particles within the fluid ink of inkjet printheads (and other fluid ejection devices) can reduce and/or block the flow of ink into the ink firing chambers, which can reduce the overall print quality in inkjet printers. There are a number of potential sources for the small particles carried within the ink, including ink storage mechanisms such as porous foam material, and materials used in the printhead manufacturing process (e.g., SiN particles from the backside wet etch mask process on the printhead). In some cases, long fiber particles from these sources can block the flow of ink into multiple adjacent chambers and their corresponding nozzles. In such cases, a long fiber particle carried by the ink can become lodged on an ink feed hole shelf and across multiple adjacent channel inlets that lead to multiple adjacent corresponding ink chambers. The diminished or blocked ink flow into multiple adjacent ink firing chambers can cause multiple adjacent corresponding nozzles to either not fire ink drops, or to fire misdirected or reduced-size ink drops. These circumstances can cause inkjet printers to produce printed pages that have missing portions of text and/or images and other similar noticeable print defects.

Previous approaches for dealing with defects caused by such ink blockages include the use of scanning print modes that enable multiple print passes. While a scanning print mode that uses multiple passes to compensate for defective/blocked nozzles is generally effective, it is not applicable in single-pass print modes (i.e., with page wide array printers), and it has the drawback of decreasing the print speed. Another solution is to employ spare or redundant nozzles. Redundant nozzles can be used in both scanning print modes and single-pass print modes. While the use of redundant nozzles can also effectively compensate for defective/blocked nozzles, this solution adds cost and reduces print resolution by the number of redundant nozzles being used.

Other approaches to dealing with defects from ink blockages include the use of multiple channel inlets that lead to the ink firing chambers, which reduces the chances that ink flow to the chambers will be blocked. Still other approaches include the use of barriers that prevent particles from reaching the channel inlets leading to the ink firing chambers. Such barriers can include pillar structures located near the channel inlets. The placement, size, and spacing of the pillars are generally designed to prevent particles of the smallest anticipated size from blocking the inlets to channels that lead to the ink firing chambers. These latter approaches, while beneficial in reducing blockage caused by small particles, are generally less effective for preventing ink blockage caused by long fiber particles that become lodged on the ink feed hole shelf across multiple adjacent channel inlets, as in the circumstances noted above.

Embodiments of the present disclosure help prevent particles, including long fiber particles, from blocking fluid flow in fluid ejection devices such as inkjet printheads, by employing an enhanced particle tolerant design that extends an existing thin-film layer (i.e., an ink feed hole layer) partially into a fluid slot. While prior particle tolerant architecture designs prevent small particles in the fluid from entering fluid channel inlets that lead to fluidic chambers, the disclosed particle tolerant thin-film extension also prevents longer particles from settling length-wise on a shelf region in front of the channel inlets that lead to fluid chambers. The long particles are therefore prevented from blocking fluid flow into the fluid chambers.

In one example, a fluid ejection device includes a thin-film layer (i.e., the ink feed hole layer) formed over a substrate. The device also includes a chamber layer formed over the thin-film layer. The chamber layer defines a fluidic channel that leads to a firing chamber. A slot extends through the substrate and into the chamber layer through an ink feed hole in the thin-film layer. Thus, the thin-film layer is also referred to as an ink feed hole layer. The thin-film layer protrudes into the slot from between the substrate and the chamber layer as a particle tolerant think-film extension.

In another example, a fluid ejection device includes comprising a fluid slot extending through a substrate and a chamber layer, a thin-film layer between the substrate and chamber layer comprising an ink feed hole that opens the slot between the substrate and chamber layer, a nozzle layer formed over the chamber layer that encloses the slot, and a particle tolerant thin-film extension that extends the thin-film layer into the slot from between the substrate and the chamber layer.

Illustrative Embodiments

FIG. 1 illustrates a fluid ejection system implemented as an inkjet printing system 100, according to an embodiment of the disclosure. Inkjet printing system 100 generally includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. In this embodiment, fluid ejection devices 114 are implemented as fluid drop jetting printheads 114 (i.e., inkjet printheads 114). Inkjet printhead assembly 102 includes at least one fluid drop jetting printhead 114 that ejects drops of ink through a plurality of orifices or nozzles 116 toward print media 118 so as to print onto the print media 118. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As discussed further below, each printhead 114 comprises a particle tolerant thin-film extension 119 that extends a thin-film layer out into the fluid slot from between a substrate and chamber layer to prevent particles from blocking ink flow into the fluidic architectures (e.g., fluidic channels and chambers) of the chamber layer.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In some implementations, inkjet printhead assembly 102 and ink supply assembly 104 are housed together in an inkjet cartridge or pen. In other implementations, ink supply assembly 104 is separate from inkjet printhead assembly 102 and supplies ink to inkjet printhead assembly 102 through an interface connection, such as a supply tube. In either implementation, reservoir 120 of ink supply assembly 104 may be removed, replaced, and/or refilled. Where inkjet printhead assembly 102 and ink supply assembly 104 are housed together in an inkjet cartridge, reservoir 120 can include a local reservoir located within the cartridge as well as a larger reservoir located separately from the cartridge. A separate, larger reservoir serves to refill the local reservoir. Accordingly, a separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly. As such, mounting assembly 106 includes a carriage for moving inkjet printhead assembly 102 relative to media transport assembly 108 to scan print media 118. In another implementation, inkjet printhead assembly 102 is a non-scanning type printhead assembly, such as a page wide array (PWA) print bar. As such, mounting assembly 106 fixes inkjet printhead assembly 102 at a prescribed position relative to media transport assembly 108. Thus, media transport assembly 108 positions print media 118 relative to inkjet printhead assembly 102.

In one implementation, inkjet printhead assembly 102 includes one printhead 114. In another implementation, inkjet printhead assembly 102 comprises a page wide array assembly with multiple printheads 114. In page wide array assemblies, an inkjet printhead assembly 102 typically includes a carrier or print bar that carries the printheads 114, provides electrical communication between the printheads 114 and the electronic controller 110, and provides fluidic communication between the printheads 114 and the ink supply assembly 104.

In one implementation, inkjet printing system 100 is a drop-on-demand thermal bubble inkjet printing system where the printhead(s) 114 is a thermal inkjet (TIJ) printhead. The TIJ printhead implements a thermal resistor ejection element in an ink chamber to vaporize ink and create bubbles that force ink or other fluid drops out of a nozzle 116. In another implementation, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle.

Electronic printer controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters.

Figure 2:
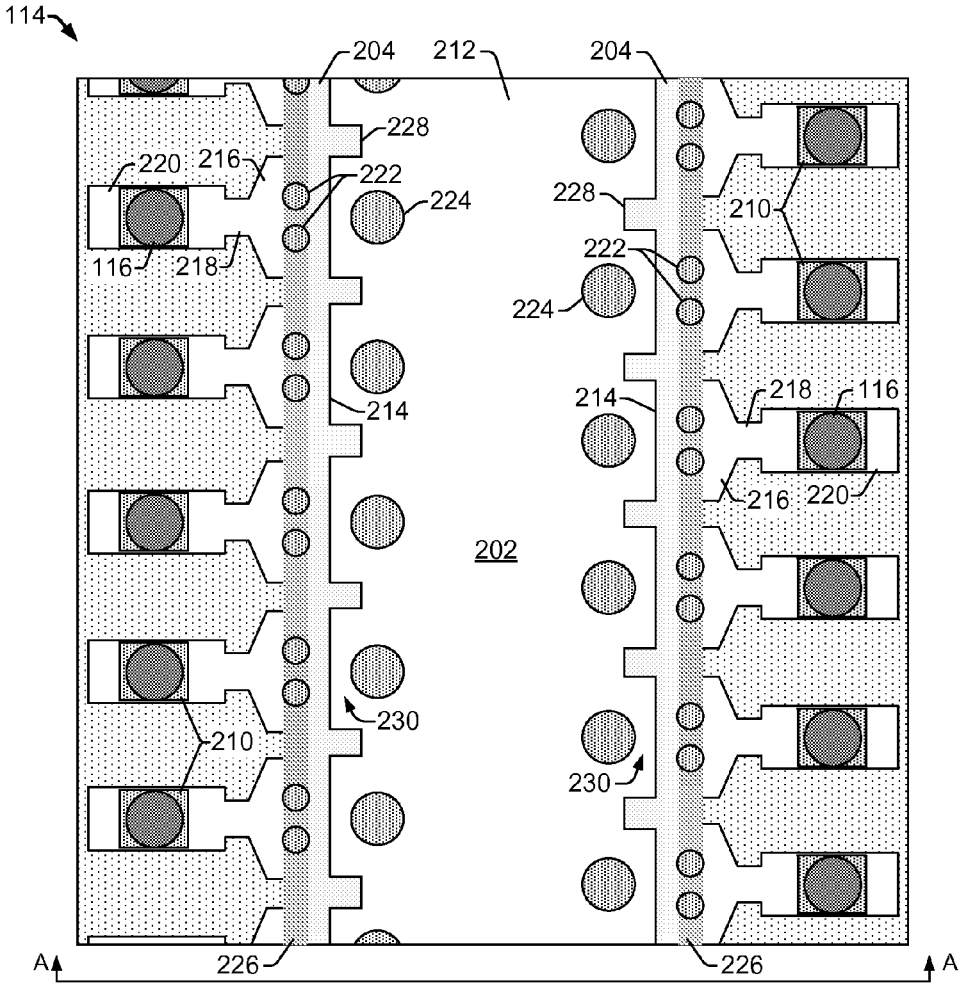
FIG. 2 shows a plan view of a portion of an example fluid ejection device 114, according to an embodiment.
Figure 3:
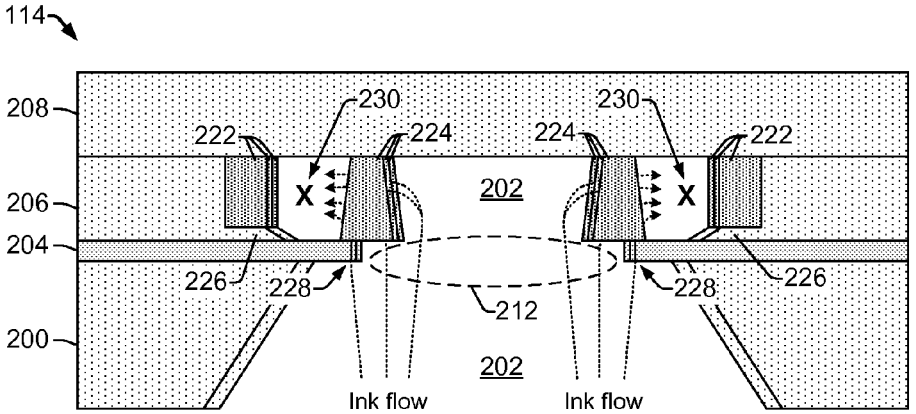
FIG. 3 shows a side view taken from the example fluid ejection device shown in FIG. 2, according to an embodiment.

FIG. 2 shows a plan view of a portion of an example fluid ejection device 114 (i.e., printhead 114), according to an embodiment of the disclosure. The portion of printhead 114 shown in FIG. 2 illustrates architectural features from each of several different layers of the printhead 114. The various layers, components, and architectural features of printhead 114 can be formed using various precision microfabrication and integrated circuit fabrication techniques such as electroforming, laser ablation, anisotropic etching, sputtering, spin coating, dry film lamination, dry etching, photolithography, casting, molding, stamping, machining, and the like. FIG. 3 shows a side view (view A-A) taken from the example fluid ejection device 114 shown in FIG. 2.

Referring generally to both FIGS. 2 and 3, printhead 114 is formed in part, of a layered architecture that includes a substrate 200 (e.g., glass, silicon) with a fluid slot 202, or trench, formed therein. Running along either side of the slot 202 are columns of fluid drop ejectors that generally comprise thermal resistors, fluid chambers, and nozzles. Formed over the substrate 200 is a thin-film layer 204, a chamber layer 206, and a nozzle layer 208. The thin-film layer 204 implements thin film thermal resistors 210 (FIG. 2) and associated electrical circuitry such as drive circuits and addressing circuits (not shown) that operate to eject fluid drops from printhead 114. Removal of a portion of the thin-film layer 204 also provides an ink feed hole 212 (shown as a dotted ellipse in FIG. 3) between the substrate 200 and the chamber layer 206 that allows fluid flow between the substrate and chamber layer by enabling an extension of the slot 202 into the chamber layer 206 from the substrate 200. The dotted lines with arrows in FIG. 3 show the general direction of ink flow through the slot 202 from the substrate 200 and into the chamber layer 206. In FIG. 2, the flow of ink through the slot 202 from the substrate 200 and into the chamber layer 206 would be a flow that proceeds into the page, from the viewer's perspective. Accordingly, the thin-film layer 204 may also be referred to as the ink feed hole layer 204.

In the example implementation shown in FIG. 2, thermal resistors 210 in the thin-film layer 204 are located in columnar arrays along longitudinal ink feed hole edges 214 formed in the thin-film layer 204. The thin-film layer 204 comprises a number of different layers (not illustrated individually) that include, for example, an oxide layer, a metal layer that defines the thermal resistors 210 and conductive traces, and a passivation layer. A passivation layer can be formed of several materials, such as silicon oxide, silicon carbide, and silicon nitride.

The chamber layer 206 formed over thin-film layer 204, includes a number of fluidic features such as channel inlets 216 that lead to fluidic channels 218 and the fluid/ink firing chambers 220. As shown in FIG. 2, the fluidic firing chambers 220 are formed around and over corresponding thermal resistors 210 (ejection elements). The chamber layer 206 is formed, for example, of a polymeric material such as SUB, commonly used in the fabrication of microfluidic and MEMS devices.

In some implementations, the chamber layer 206 also includes particle tolerant architectures in the form of particle tolerant pillars (222, 224). On-shelf pillars 222, formed during the fabrication of chamber layer 206, are located on a shelf 226 of the chamber layer 206 near the channel inlets 216. The on-shelf pillars 222 help prevent small particles in the ink from entering the channel inlets 216 and blocking ink flow to chambers 220. Off-shelf pillars 224, or hanging pillars 224, are also formed during the fabrication of chamber layer 206. The hanging pillars 224 are formed prior to formation of the slot 202, and they are adhered to the nozzle layer 208. Thus, when slot 202 is formed, hanging pillars 224 effectively "hang" in place through their adherence to the nozzle layer 208. Both the on-shelf pillars 222 and hanging pillars 224 help stop small particles from entering the channel inlets 216 and blocking ink flow to chambers 220.

Nozzle layer 208 is formed on the chamber layer 206 and includes nozzles 116 that each correspond with a respective chamber 220 and thermal resistor ejection element 210. The Nozzle layer 208 forms a top over the slot 202 and other fluidic features of the chamber layer 206 (e.g., the channel inlets 216, fluidic channels 218, and the fluid/ink firing chambers 220). The nozzle layer 208 is typically formed of SU8 epoxy, but it can also be made of other materials such as a polyimide.

In addition to the particle tolerant pillars 222, 224, in the chamber layer 206, printhead 114 also includes a particle tolerant thin-film extension 228. The particle tolerant thin-film extension 228 comprises an extension of the thin-film layer 204 out from between the substrate 200 and chamber layer 206, and into the slot 202. In general, the particle tolerant thin-film extension 228 enhances the ability of the printhead 114 to manage small particles within the ink and prevent them from diminishing or blocking ink flow to the chambers 220. More specifically, however, the particle tolerant thin-film extension 228 prevents longer particles from settling length-wise in the fluidic shelf region 230 located in front of the channel inlets 216 that lead to fluid chambers 220. In FIG. 3, this the fluidic shelf region 230 is labeled with an "X", and it lies between the on-shelf pillars 222 and the hanging pillars 224.

Figure 4:
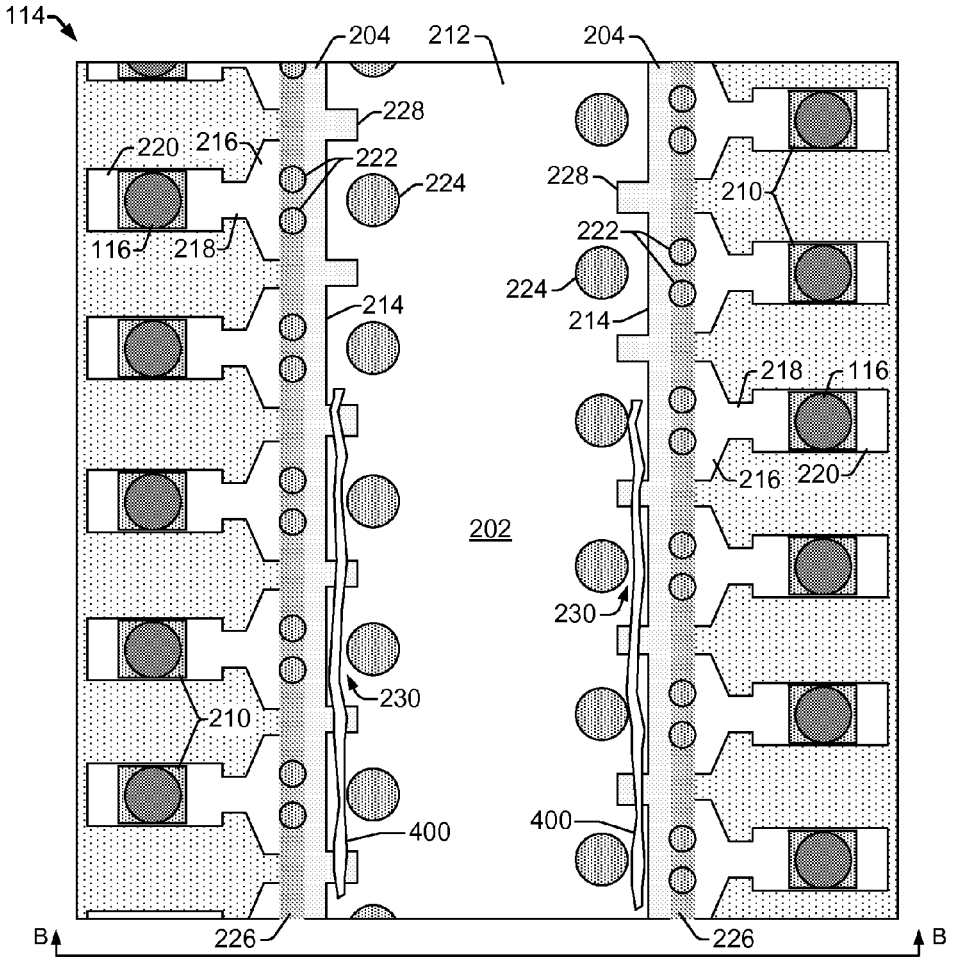
FIG. 4 shows a plan view of a portion of an example fluid ejection device illustrating how a particle tolerant thin-film extension prevents a long particle from blocking ink flow to fluid chambers, according to an embodiment.
Figure 5:
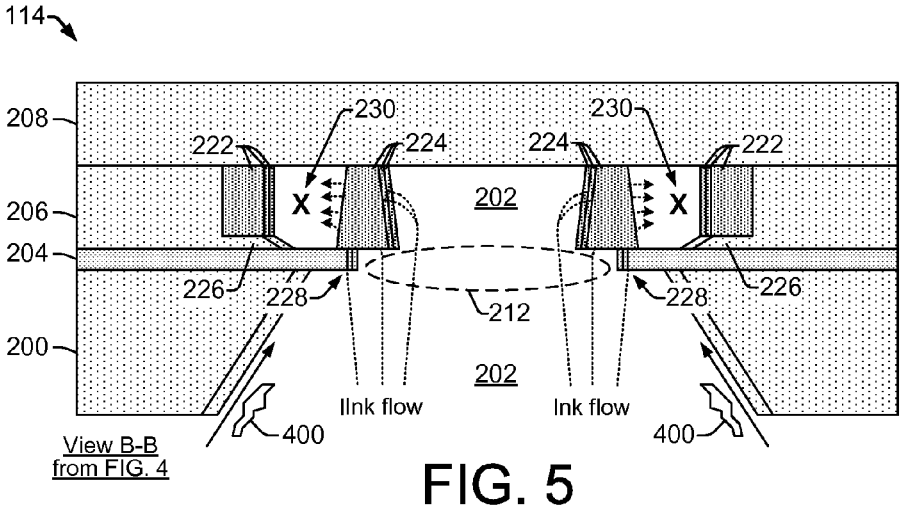
FIG. 5 shows a side view taken from the example fluid ejection device shown in FIG. 4, according to an embodiment.

FIG. 4 shows a plan view of a portion of an example fluid ejection device 114 (i.e., printhead 114) illustrating how a particle tolerant thin-film extension 228 prevents a long particle 400 from blocking ink flow to fluid chambers 220, according to an embodiment of the disclosure. FIG. 5 shows a side view (view B-B) taken from the example fluid ejection device 114 shown in FIG. 4. The printheads 114 in FIGS. 4 and 5 are the same as or similar to those shown in FIGS. 2 and 3, except that they include an illustration of how the particle tolerant thin-film extension 228 functions to prevent long particles 400 from blocking or diminishing ink flow to the printhead ink chambers 220.

Referring to FIGS. 4 and 5, long particles 400 within fluid ink can travel through the fluid slot 202 in the direction of the ink flow. The long particles can travel along the sides of the slot 202 toward the fluidic shelf region 230 (FIG. 4; marked "X") of the chamber layer 206 near the channel inlets 216 that lead to fluid chambers 220. If the long particles 400 come to rest, or get lodged in the fluidic shelf region 230, they can block the flow of ink into the channel inlets 216 that lead to fluid chambers 220. As is apparent from FIG. 4, multiple adjacent channel inlets 216 can be blocked by such long particles 400. However, as FIG. 4 also shows, the particle tolerant thin-film extension 228 prevents the long particles 400 from reaching the fluidic shelf region 230.

FIGS. 2-5 show one of various possible designs of a particle tolerant thin-film extension 228. In particular, the particle tolerant thin-film extension 228 of FIGS. 2-5 comprises a plurality of thin-film, finger-like, protrusions that are partially interleaved between the hanging pillars 224. The interleaving of the protrusions in the particle tolerant thin-film extension 228 with the hanging pillars 224 prevents the long particles 400 from coming to rest or lodging in the fluidic shelf region 230 between the on-shelf pillars 222 and the hanging pillars 224. However, various other designs of a particle tolerant thin-film extension 228 are possible and are contemplated by this disclosure, that can achieve a similar result of preventing long particles from coming to rest or lodging in the fluidic shelf region 230 between the on-shelf pillars 222 and the hanging pillars 224.

Figure 6:
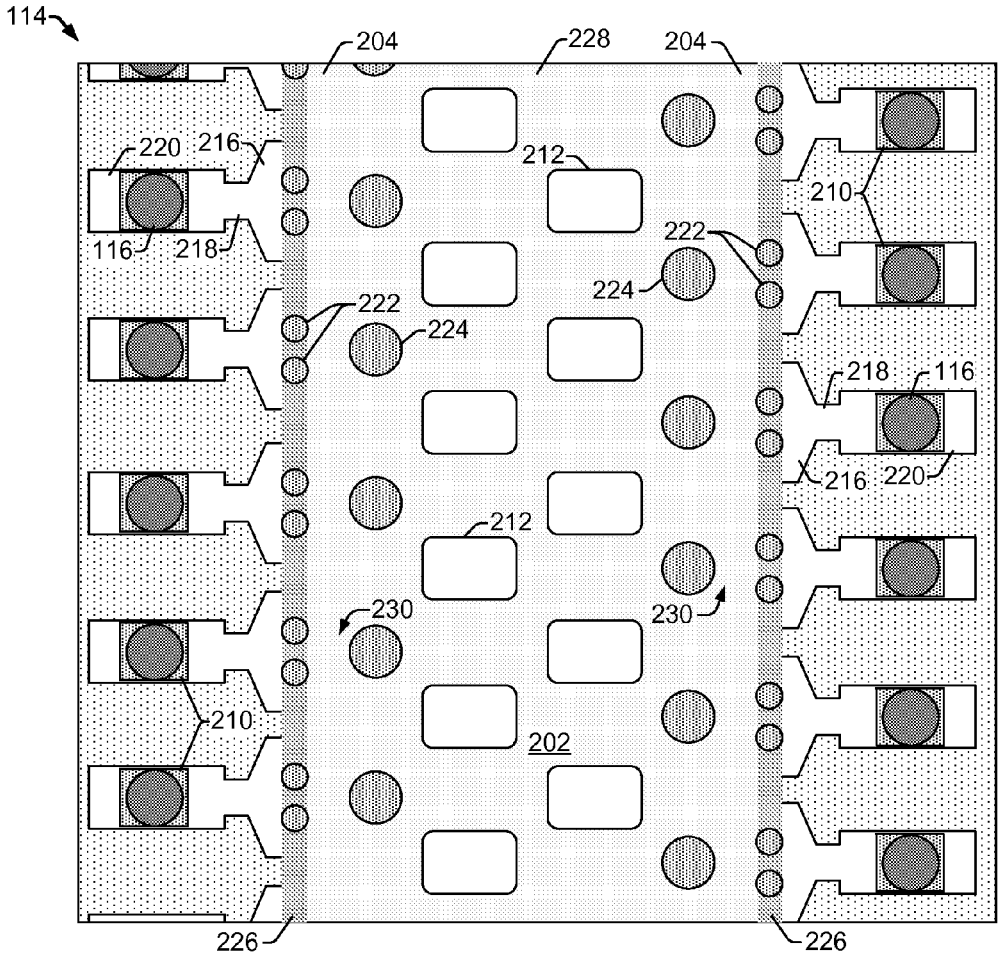
FIG. 6 shows a plan view of a portion of an example fluid ejection device with a varying design of a particle tolerant thin-film extension, according to an embodiment.
Figure 7:
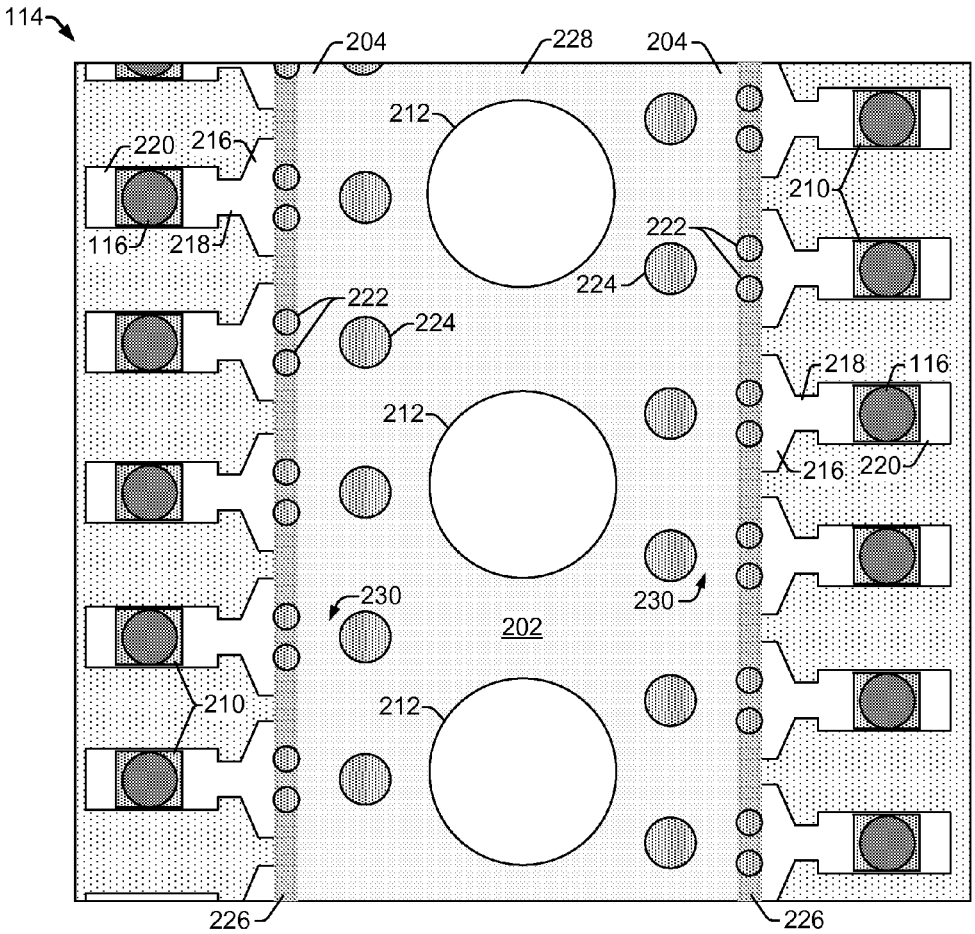
FIG. 7 shows a plan view of a portion of an example fluid ejection device with a varying design of a particle tolerant thin-film extension, according to an embodiment.
Figure 8:
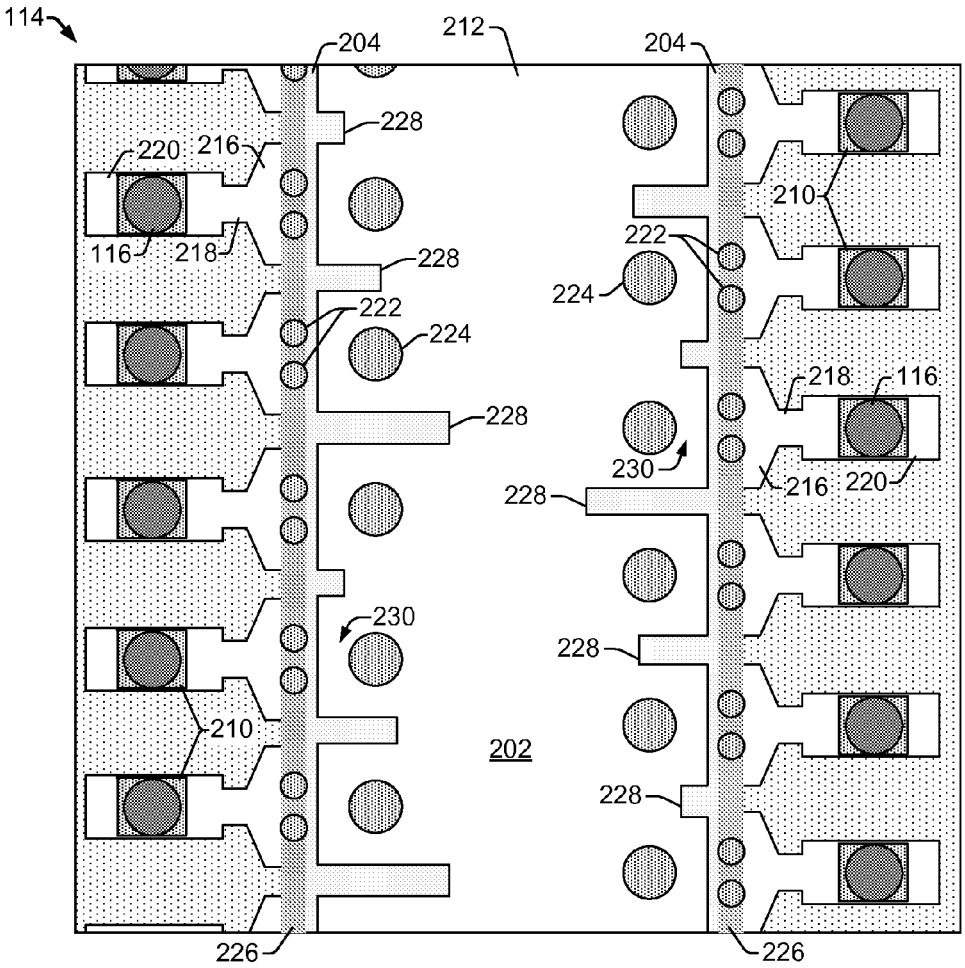
FIG. 8 shows a plan view of a portion of an example fluid ejection device with a varying design of a particle tolerant thin-film extension, according to an embodiment.

FIGS. 6-8 show plan views of a portion of example fluid ejection devices 114 (i.e., printhead 114) with varying designs of particle tolerant thin-film extensions 228, according to embodiments of the disclosure. As shown in FIG. 6, the thin film layer 204 can protrude from between the substrate 200 and chamber layer 206 as a particle tolerant thin-film extension 228 that extends all the way across the slot 202. That is, the particle tolerant thin-film extension 228 spans the entire width of the slot 202 between the columns of fluid drop ejectors located on either side of the slot 202. In this illustration, the slot 202 extends both above and below the particle tolerant thin-film extension 228. That is, although the substrate 200 and chamber layer 206 are not shown, the slot 202 still extends through both the substrate 200 and the chamber layer 206, as in the previous design. However, instead of having a singular large ink feed hole 212 as shown in FIGS. 2-5, the FIG. 6 design comprises multiple ink feed holes 212 in the particle tolerant thin-film extension 228 that enable fluid ink to flow through the slot 202 between the substrate and the chamber layer 206. While the multiple ink feed holes 212 in the FIG. 6 design are rectangular in shape, other shapes are possible that may provide the same benefits of preventing long particles from coming to rest or lodging in the fluidic shelf region 230 between the on-shelf pillars 222 and the hanging pillars 224.

FIG. 7 shows another example printhead 114 with a different design of a particle tolerant thin-film extension 228 that is similar to the design of FIG. 6. Like in FIG. 6, the particle tolerant thin-film extension 228 of FIG. 7 extends all the way across the slot 202. In addition, instead of having a singular large ink feed hole 212 as shown in FIGS. 2-5, the FIG. 7 design comprises multiple ink feed holes 212 in the particle tolerant thin-film extension 228 that enable fluid ink to flow through the slot 202 between the substrate and the chamber layer 206 (not shown in FIG. 7). The multiple ink feed holes 212 in the particle tolerant thin-film extension 228 of FIG. 7, however, are both fewer and larger than the ink feed holes 212 in FIG. 6. The larger ink feed holes 212 in FIG. 7 are circular, but may in other examples be shaped differently to provide the benefits of preventing long particles from coming to rest or lodging in the fluidic shelf region 230 between the on-shelf pillars 222 and the hanging pillars 224.

FIG. 8 shows another example printhead 114 with a different design of a particle tolerant thin-film extension 228 that is similar to the design shown in FIGS. 2-5. As in the design shown in FIGS. 2-5, the particle tolerant thin-film extension 228 of FIG. 8 does not extend all the way across the slot 202, and there is generally, a singular large ink feed hole 212 similar to that of the design in FIGS. 2-5. In FIG. 8, the particle tolerant thin-film extension 228 comprises a plurality of thin-film, finger-like, protrusions that are partially interleaved between the hanging pillars 224. However, the particle tolerant thin-film extension 228 protrusions in the FIG. 8 design extend into the slot 202 in varying lengths. That is, the protrusions 228 in FIG. 8 are not the same length as is generally the case with the design shown in FIGS. 2-5. However, like the design shown in FIGS. 2-5, the particle tolerant thin-film extension 228 protrusions of varying lengths in the FIG. 8 design are interleaved with the hanging pillars 224 to prevent long particles 400 from coming to rest or lodging in the fluidic shelf region 230 between the on-shelf pillars 222 and the hanging pillars 224.

While various other designs of a particle tolerant thin-film extension 228 are possible and are contemplated by this disclosure, it is noted that different designs may provide varying degrees of robustness associated with the particle tolerant thin-film extension 228 itself. For example, the shorter particle tolerant thin-film extension 228 protrusions shown in FIGS. 2-5 may be more robust and therefore less prone to damage than the longer particle tolerant thin-film extension 228 protrusions shown in FIG. 8. Likewise, the particle tolerant thin-film extensions 228 that extend all the way across the slot 202 as shown in FIGS. 6 and 7, may be more robust and less prone to damage than the longer particle tolerant thin-film extension 228 protrusions shown in FIG. 8.

Figure 9:
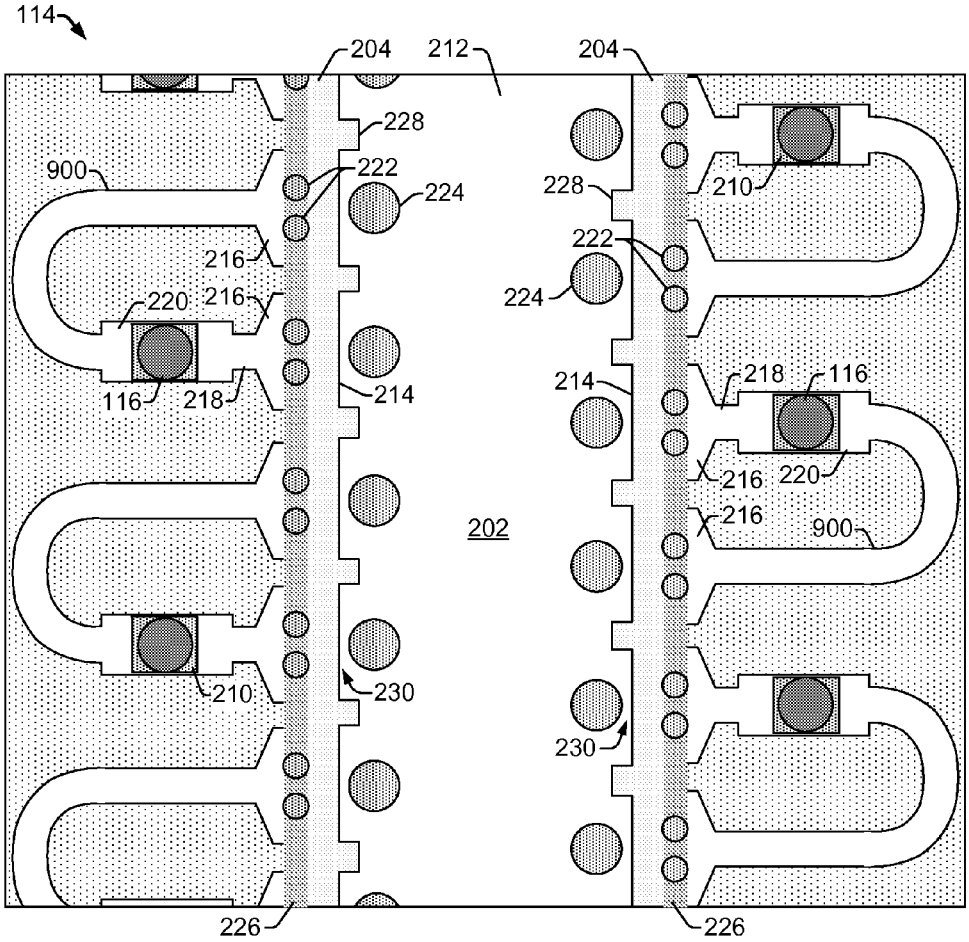
FIG. 9 shows a plan view of a portion of an example fluid ejection device comprising a recirculation channel and a particle tolerant thin-film extension, according to an embodiment.

FIG. 9 shows a plan view of a portion of an example fluid ejection device 114 (i.e., printhead 114) comprising a recirculation channel and a particle tolerant thin-film extension 228, according to an embodiment of the disclosure. In each of the printheads 114 discussed above with regard to FIGS. 2-8, the general fluidic architecture of the chamber layer 206 comprises a single channel inlet 216 in communication with a single fluidic channel 212 that leads to a fluid chamber 220. However, the various designs of a particle tolerant thin-film extension 228 are also applicable to printheads 114 having recirculation channels 900 (and other fluidic architectures) that circulate ink through the fluid chamber 220 between two channel inlets 216.

As shown in FIG. 9, for example, the chamber layer 206 (not shown) defines a recirculation channel 900 that enables ink circulation through the fluid chamber 220 between two channel inlets 216 that are in fluid communication with the slot 202. As in the previous examples that each comprise single channel inlets 216, a particle tolerant thin-film extension 228 employed in the example of FIG. 9 functions in a similar manner as discussed above to prevent long particles from coming to rest or lodging in the fluidic shelf region 230 between the on-shelf pillars 222 and the hanging pillars 224. Thus, the particle tolerant thin-film extension 228 prevents the long particles from inhibiting ink flow at both channel inlets 216 associated with the recirculation channels 900 in the example printhead 114 of FIG. 9.

What is claimed is:

1. A fluid ejection device, comprising:
- a thin-film layer formed over a substrate;
- a chamber layer formed over the thin-film layer and defining a fluidic channel leading to a firing chamber;
- a slot extending through the substrate and into the chamber layer through an ink feed hole in the thin-film layer;
- a particle tolerant thin-film extension of the thin-film layer that protrudes into the slot from between the substrate and the chamber layer;
- a nozzle layer over the chamber layer that forms a top over the firing chamber, the fludic channel, and the slot; and
- hanging pillars defined in the chamber layer and adhered to the top such that they extend into the slot.

2. A fluid ejection device as in claim 1, wherein the particle tolerant thin-film extension includes a plurality of thin-film protrusions partially interleaved between the hanging pillars.

3. A fluid ejection device, comprising:
- a thin-film layer formed over a substrate;
- a chamber layer formed over the thin-film layer, the chamber layer defining a fluidic channel leading to a firing chamber;
- a slot extending through the substrate and into the chamber layer through an ink feed hole in the thin-film layer;
- a particle tolerant thin-film extension of the thin-film layer that protrudes into the slot from between the substrate and the chamber layer;
- a nozzle layer over the chamber layer that forms a top over the firing chamber, the fluidic channel, and the slot; and shelf pillars defined in the chamber layer and located at an inlet to the fluidic channel.

4. A fluid ejection device as in claim 1, wherein the particle tolerant thin-film extension spans across an entire width of the slot.

5. A fluid ejection device as in claim 4, wherein the particle tolerant thin-film extension includes multiple ink feed holes.

6. A fluid ejection device as in claim 2, wherein the thin-film protrusions include thin-film protrusions of varying lengths.

7. A fluid ejection device as in claim 1, wherein the fluidic channel includes a recirculation channel that leads to the firing chamber from first and second channel inlets in fluid communication with the slot.

8. A fluid ejection device as in claim 1, further including a thermal resistor formed on the thin-film layer within the firing chamber.

9. A fluid ejection device, comprising:

a fluid slot extending through a substrate and a chamber layer;

a thin-film layer between the substrate and the chamber layer including an ink feed hole that provides fluid communication between the substrate and the chamber layer via the slot;

a nozzle layer formed over the chamber layer, the nozzle layer enclosing the slot;

a particle tolerant thin-film extension that extends the thin-film layer into the slot from between the substrate and the chamber layer;

hanging pillars in the chamber layer that are adhered to the nozzle layer and that hang into the slot; and protrusions in the particle tolerant thin-film extension interleaved between the hanging pillars.

10. A fluid ejection device as in claim 9, wherein the particle tolerant thin-film extension extends across the slot, and the ink feed hole includes multiple ink feed holes in the particle tolerant thin-film extension.

11. A fluid ejection device as in claim 10, wherein the multiple ink feed holes include at least one of rectangular shapes or circular shapes.

12. A fluid ejection device as in claim 9, further including:

a fluidic chamber formed in the chamber layer and coupled to the slot through a fluidic channel;

a thermal resistor formed in the thin-film layer and located within the fluidic chamber; and a nozzle formed in the nozzle layer over the fluidic chamber.

13. A fluid ejection device as in claim 3, wherein the particle tolerant thin-film extension spans across an entire width of the slot.

14. A fluid ejection device as in claim 13, wherein the particle tolerant thin-film extension includes multiple ink feed holes.

15. A fluid ejection device as in claim 3, wherein the fluidic channel includes a recirculation channel that leads to the firing chamber from first and second channel inlets in fluid communication with the slot.

16. A fluid ejection device as in claim 3, further including a thermal resistor formed on the thin-film layer and within the firing chamber.

* * * * *